US008110974B2

(12) United States Patent
Matsumura

(10) Patent No.: US 8,110,974 B2
(45) Date of Patent: Feb. 7, 2012

(54) ELECTRON BEAM GENERATING APPARATUS

(75) Inventor: Tatsuya Matsumura, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 235 days.

(21) Appl. No.: 12/281,713

(22) PCT Filed: Feb. 8, 2007

(86) PCT No.: PCT/JP2007/052207
§ 371 (c)(1),
(2), (4) Date: Nov. 11, 2008

(87) PCT Pub. No.: WO2007/105390
PCT Pub. Date: Sep. 20, 2007

(65) Prior Publication Data

US 2009/0212681 A1 Aug. 27, 2009

(30) Foreign Application Priority Data

Mar. 10, 2006 (JP) ..... 2006-066486

(51) Int. Cl.
*H01J 33/00* (2006.01)

(52) U.S. Cl. ..... 313/420; 313/317

(58) Field of Classification Search ..... 313/317, 313/415–419, 420
See application file for complete search history.

(56) References Cited

U.S. PATENT DOCUMENTS

| | | | | |
|---|---|---|---|---|
| 3,211,937 | A | | 10/1965 | Hester et al. |
| 3,906,392 | A | * | 9/1975 | Mann ..... 372/74 |
| 5,962,995 | A | | 10/1999 | Avnery |
| 6,097,790 | A | | 8/2000 | Hasegawa et al. |

FOREIGN PATENT DOCUMENTS

| | | |
|---|---|---|
| DE | 30 22 127 A1 | 1/1982 |
| JP | 48-34000 | 4/1973 |
| JP | 48-103798 | 12/1973 |
| JP | 60-148999 | 10/1985 |
| JP | S61-009812 U | 1/1986 |
| JP | 3-116643 | 5/1991 |
| JP | 9-203800 | 8/1997 |
| JP | 10-239500 | 9/1998 |
| JP | 2001-059900 | 3/2001 |
| JP | 2001-507800 | 6/2001 |
| JP | 2004-165052 | 6/2004 |
| JP | 2004-170353 | 6/2004 |
| JP | 2004-354309 | 12/2004 |
| JP | 2005-017077 | 1/2005 |
| JP | 2005-91107 | 4/2005 |

OTHER PUBLICATIONS

English translation of JP 2004-354309A.*

* cited by examiner

*Primary Examiner* — Anne Hines

(74) *Attorney, Agent, or Firm* — Drinker Biddle & Reath LLP

(57) ABSTRACT

An electron beam generating apparatus (1*a*) includes an electron gun (2), a vacuum container (3), a frame material (11), and a window material (13). The electron gun (2) has a filament (7) from which an electron beam (EB) is emitted. The vacuum container (3) holds the filament (7). The frame material (11) has an electron passing hole (11*c*) through which the electron beam (EB) passes, and is detachably attached to the vacuum container (3). The window material (13) is bonded (brazed) to the frame material (11) so as to airtightly stop up the electron passing hole (11*c*), and allows the electron beam (EB) to penetrate therethrough.

10 Claims, 12 Drawing Sheets

(a)

(b)

(a)

(b)

ELECTRON BEAM GENERATING APPARATUS

TECHNICAL FIELD

This invention relates to an electron beam generating apparatus.

BACKGROUND ART

An electron beam generating apparatus is provided with a window material used to emit an electron beam from a vacuum container outwardly. For example, Patent Document 1 discloses an irradiation window of an electron beam irradiation apparatus having a window material (window foil). FIG. 12 illustrates a structure of this irradiation window. In the irradiation window 100, a window foil 101 is placed between a grid window 102 having an opening through which electrons "e" are allowed to pass and a foil retaining plate 103, and is fixed by bolts 104. A gap between the window foil 101 and the grid window 102 is sealed with an O ring 105. The grid window 102 is held by a window holder 106. The window holder 106 is attached to a vacuum chamber 108 by bolts 107. A space between the window holder 106 and the vacuum chamber 108 is sealed with an O ring 109. A space between the foil retaining plate 103 and the window holder 106 is sealed with an elastic packing 110.

Patent Document 1: Japanese Published Unexamined Patent Application No. H9-203800

DISCLOSURE OF THE INVENTION

Problems to be Solved by the Invention

In the irradiation window 100 mentioned above, the window foil 101 is interposed between the grid window 102 and the foil retaining plate 103, and is fixed by the bolts 104. In this structure, the O ring 105 is required to airtightly seal the gap between the window foil 101 and the grid window 102 (or the foil retaining plate 103). However, in general, the O ring 105 is made of an elastic substance, such as resin, and the window foil 101 reaches a high temperature when an electron beam is emitted. Therefore, if the O ring 105 is disposed to be adjacent to the window foil 101, the O ring 105 will deteriorate relatively fast, and it will become difficult to maintain the vacuum state of the vacuum chamber 108 for a long time.

Additionally, to heighten the transmissivity of the electron beam, the window material of the electron beam generating apparatus is formed as thinly as possible (nowadays, about several microns (μm) to 10 microns (μm)). However, this thinness makes it difficult to attach the window material to the electron beam generating apparatus when the electron beam generating apparatus is manufactured or when the window material is replaced with another. If the O ring 105 is disposed to be adjacent to the window foil 101 in the same way as in the irradiation window 100 mentioned above, a non-uniform stress will be generated in the window foil 101 by pressure for sealing, and there is a fear that the window foil 101 will be damaged. Especially when the window foil 101 and the O ring 105 are pressed by the bolts 104 as in the irradiation window 100, a non-uniform stress is liable to be generated in the window foil 101, and there is a high possibility that the window foil 101 will be damaged.

The present invention has been made in consideration of these problems. It is therefore an object of the present invention to provide an electron beam generating apparatus capable of maintaining a vacuum state for a longer time and capable of reducing damage inflicted on a window material.

Means for Solving the Problems

To solve the problems, the electron beam generating apparatus according to the present invention includes an electron gun that has an electron emitting member from which an electron beam is emitted; a container that holds the electron emitting member; a frame material detachably attached to the container, the frame material having an electron passing hole through which the electron beam passes; and a window material that is bonded to the frame material so as to airtightly stop the electron passing hole and through which the electron beam penetrates.

In this electron beam generating apparatus, the window material is bonded to the frame material so as to airtightly stop the electron passing hole. Therefore, an elastic sealing member, such as an O ring, becomes unnecessary between the frame material and the window material, and the vacuum state in the container can be maintained for a longer time. Additionally, this frame material is detachably attached to the container. Therefore, when the electron beam generating apparatus is manufactured or when the window material is exchanged with another, the window material and the frame material can be attached without giving a stress to the window material. Therefore, according to the thus structured electron beam generating apparatus, a non-uniform stress to the window material can be almost completely removed, and hence damage to the window material can be effectively reduced.

The electron beam generating apparatus may further include a sealing member with which a gap between the frame material and the container is airtightly sealed, and a groove to hold the sealing member may be formed on the container side. In a conventional structure, e.g., in the irradiation window 100 of FIG. 12, a groove to hold the O ring 109 with which a gap between the window holder 106 and the vacuum chamber 108 is sealed is formed on the window holder 106 side. In this structure, heat generated in the window material when an electron beam is emitted is easily transferred to the O ring, and hence the O ring made of an elastic material, such as resin, will easily deteriorate. On the other hand, if a groove to hold the sealing member is formed on the container side, the heat of the window material is not easily transferred to the O ring, and hence the longevity of the O ring can be extended.

In the electron beam generating apparatus, the window material may be brazed to the frame material. With this structure, the window material can be suitably bonded to the frame material, and airtightness can be achieved between the window material and the frame material. Additionally, the electron beam generating apparatus may further include a fixing member having an opening through which the electron beam passes, so that the window material is interposed between the fixing member and the frame material. The fixing member may be brazed to the window material and to the frame material. With this structure, the window material is reliably bonded to the frame material, and airtightness can be heightened.

Preferably, if the electron beam generating apparatus includes the fixing member, the frame material has a concave part whose bottom face contains an end of the electron passing hole, and the fixing member is disposed on the bottom face, and a gap lies between a sidewall of the concave part and a side face of the fixing member. Although it is desirable to allow the center of the opening of the fixing member to coincide with the center of the electron passing hole of the frame material when the electron beam generating apparatus is assembled, the position of the fixing member is easily deviated because of the melting of the brazing material when the fixing member is brazed to the frame material. According to this electron beam generating apparatus, a gap is provided between a sidewall of the concave part of the frame material and a side face of the fixing member. Therefore, when the fixing member is brazed to the frame material, the fixing member can be positioned by use of, for example, a jig having a shape to be fitted to this gap. Therefore, the center of the opening of the fixing member and the center of the electron passing hole of the frame material can easily coincide with each other.

Preferably, if the electron beam generating apparatus includes the fixing member, the fixing member is spot-welded to the frame material. As mentioned above, the position of the fixing member is easily deviated because of the melting of the brazing material when the fixing member is brazed to the frame material. Therefore, if the fixing member is beforehand spot-welded to the frame material before being brazed and is temporarily joined thereto, the fixing member can be prevented from being positionally deviated because of the melting of the brazing material. Therefore, the center of the opening of the fixing member and the center of the electron passing hole of the frame material can coincide with each other with high accuracy.

In the electron beam generating apparatus, the frame material may be screwed and fastened to the container. Alternatively, the electron beam generating apparatus may further include a presser member that is screwed to the container while pressing the frame material. Alternatively, in the electron beam generating apparatus, the frame material may be screwed to the container. Any one of these structures makes it possible to advantageously achieve a frame material detachably attached to the container.

In the electron beam generating apparatus, a width of the electron passing hole faced to the container may be expanded in a tapered manner toward an inside of the container. Since the frame material is boded to the window material in the electron beam generating apparatus, heat can be easily transferred from the window material to the frame material. If this fact is employed, an increase in temperature of the window material can be effectively curbed by heat radiation from the frame material. In other words, an increase in temperature of the window material can be effectively curbed by expanding the width of the electron passing hole faced to the container in a tapered manner and by increasing the amount of heat radiation from the electron passing hole.

In the electron beam generating apparatus, the container may have a stepped part by which the frame material is positioned. With this structure, the frame material, which is freely attached and detached, can be easily attached to the container, and the window material can be reliably prevented from being positionally deviated from the emission axis line of an electron beam.

Effects of the Invention

According to the present invention, it is possible to provide an electron beam generating apparatus capable of maintaining a vacuum state for a longer time and capable of reducing damage to a window material.

DESCRIPTION OF THE REFERENCE NUMERALS

Figure 1:
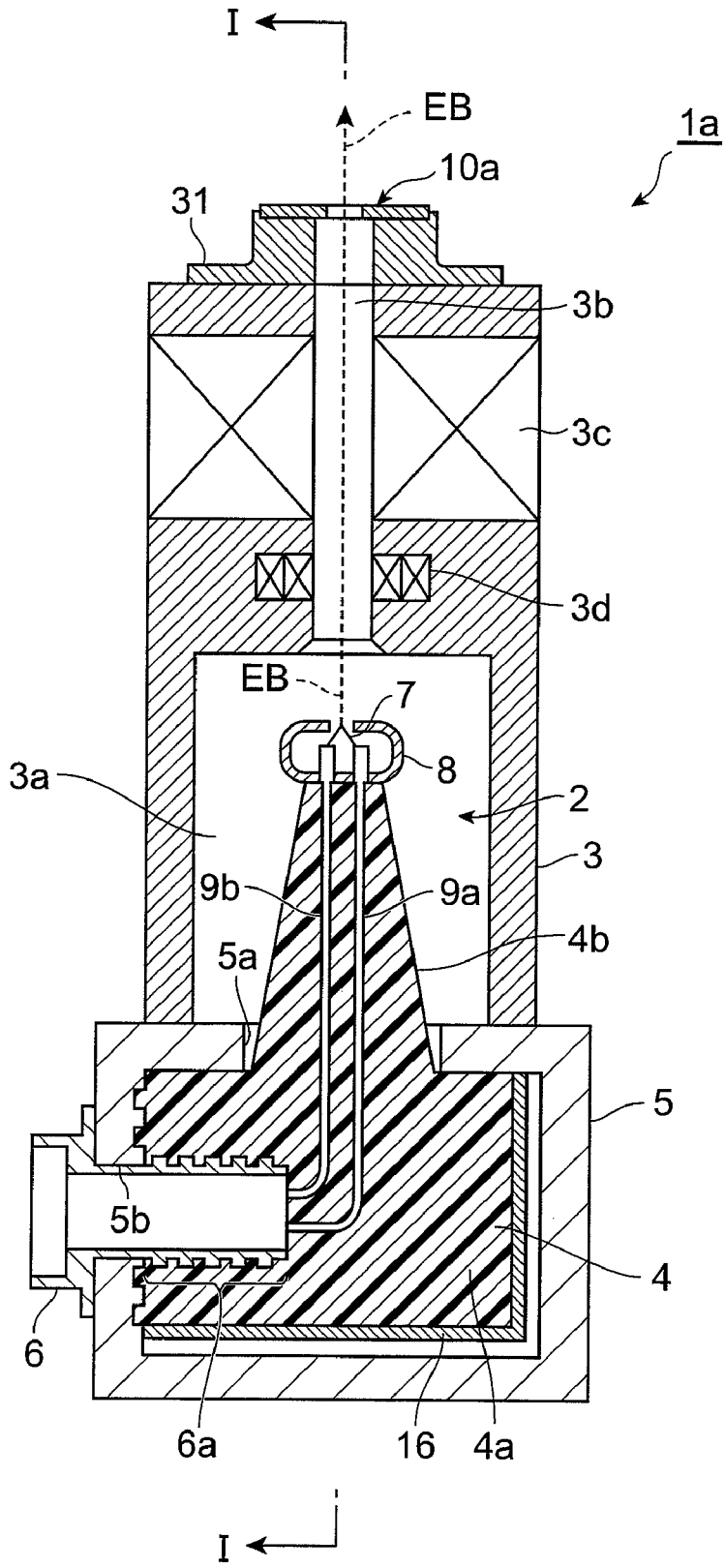
FIG. 1 is a side sectional view illustrating a structure of a first embodiment of an electron beam generating apparatus of the present invention.

1*a*, 1*b* . . . Electron beam generating apparatus
2 . . . Electron gun
3, 30 . . . Vacuum container
3*a*, 30*a* . . . Housing chamber
3*b*, 30*b* . . . Electron passage
4 . . . Insulating block
5 . . . Case
6 . . . Connector
7 . . . Filament
8 . . . Grid part
9*a*, 9*b* . . . Internal electric wire
10*a*-10*d* . . . Window unit
11, 12, 19, 20 . . . Frame material
11*a*, 12*c*, 19*a*, 20*a* . . . Concave part
11*c*, 12*e*, 19*c*, 20*c* . . . Electron passing hole
13, 21 . . . Window material
14, 22 . . . Fixing member
14*c* . . . Spot welding mark
15, 27 . . . Brazing material
16 . . . Electroconductive member
17, 28 . . . Bolt
18, 29 . . . O ring
23 . . . Presser member
31-34 . . . Pedestal
50, 51 . . . Vacuum pump
A, B . . . Jig
EB . . . Electron beam

BEST MODES FOR CARRYING OUT THE INVENTION

A detailed description will be hereinafter given of preferred embodiments of an electron beam generating apparatus of the present invention with reference to attached drawings. In the description of the drawings, the same reference character is given to the same or equivalent element, and a repeated description thereof is omitted.

First Embodiment

Figure 2:
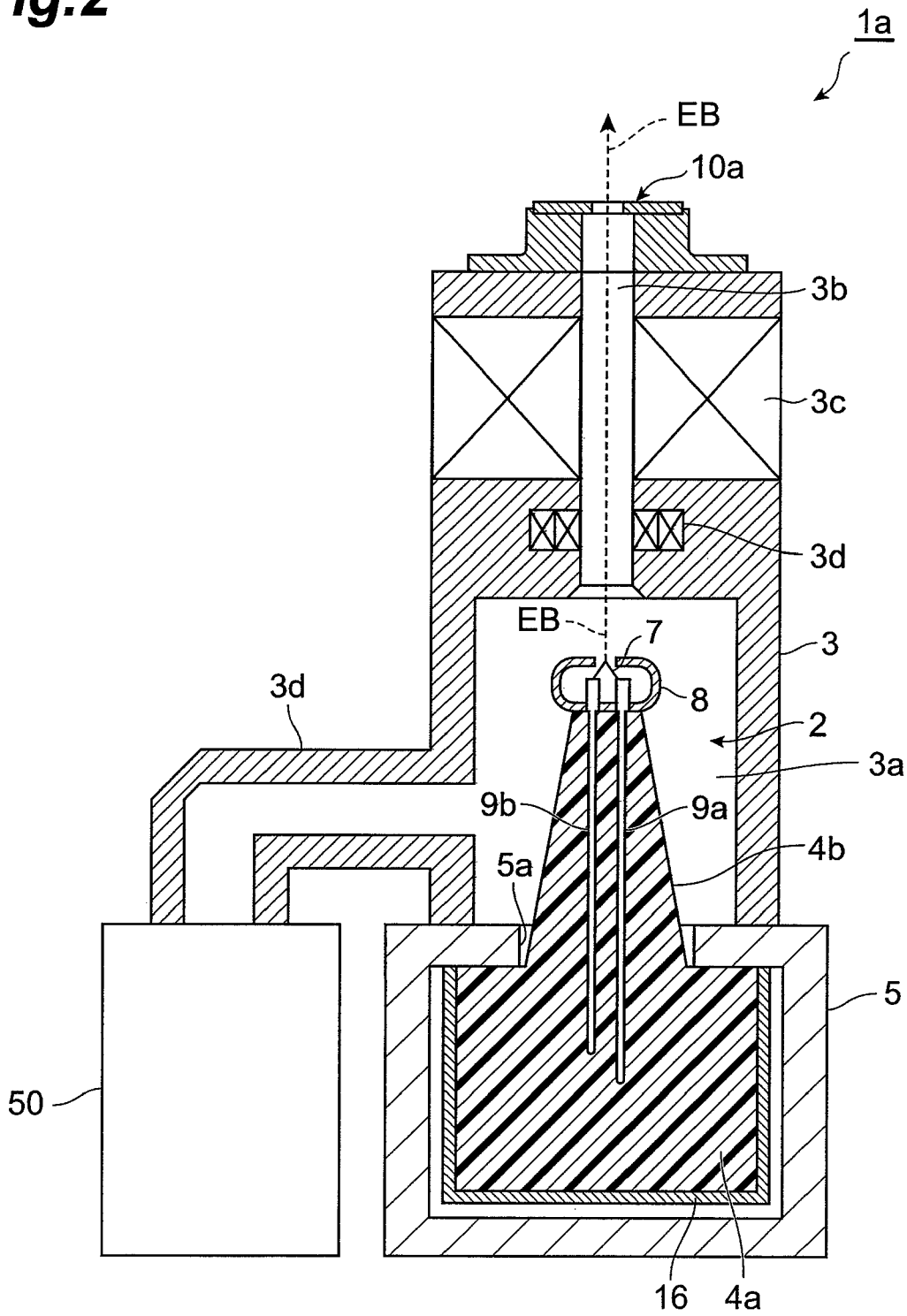
FIG. 2 is a side sectional view along line I-I of the electron beam generating apparatus of FIG. 1.

FIG. 1 is a side sectional view illustrating a structure of a first embodiment of the electron beam generating apparatus of the present invention. FIG. 2 is a side sectional view along line I-I of the electron beam generating apparatus of FIG. 1. The electron beam generating apparatus 1*a* according to this embodiment includes an electron gun 2 that emits an electron beam EB, a vacuum container 3, and a window unit 10*a*.

The vacuum container 3 is a container used to hold a filament 7 (described later) that is an electron emission member of the electron gun 2 and to airtightly seal this. The vacuum container 3 is formed in cylindrical shape extending in the direction of emission of the electron beam EB. The vacuum container 3 has its end sealed with the electron gun 2 and the other end sealed with the window unit 10*a*. The vacuum container 3 has a housing chamber 3*a* and an electron passage 3*b*. The housing chamber 3*a* is used to house the filament 7 of the electron gun 2 described later, a grid part 8, and a convex part 4*b*. The electron passage 3*b* extends in the direction of emission of an electron beam EB emitted from the electron gun 2. The electron passage 3*b* communicates with the housing chamber 3*a*. An electron beam EB emitted from the electron gun 2 passes through the electron passage 3*b*, and reaches the forward end of the vacuum container 3. A pair of electromagnetic coils 3*c* and 3*d*, which are used as a pair of elements between which the electron passage 3 is placed and which serve as an electromagnetic deflection lens, are disposed around the electron passage 3*b*. The vacuum container 3 has a pedestal 31 used to fix the window unit 10*a* at an end of the electron passage 3*b*.

Figure 3:
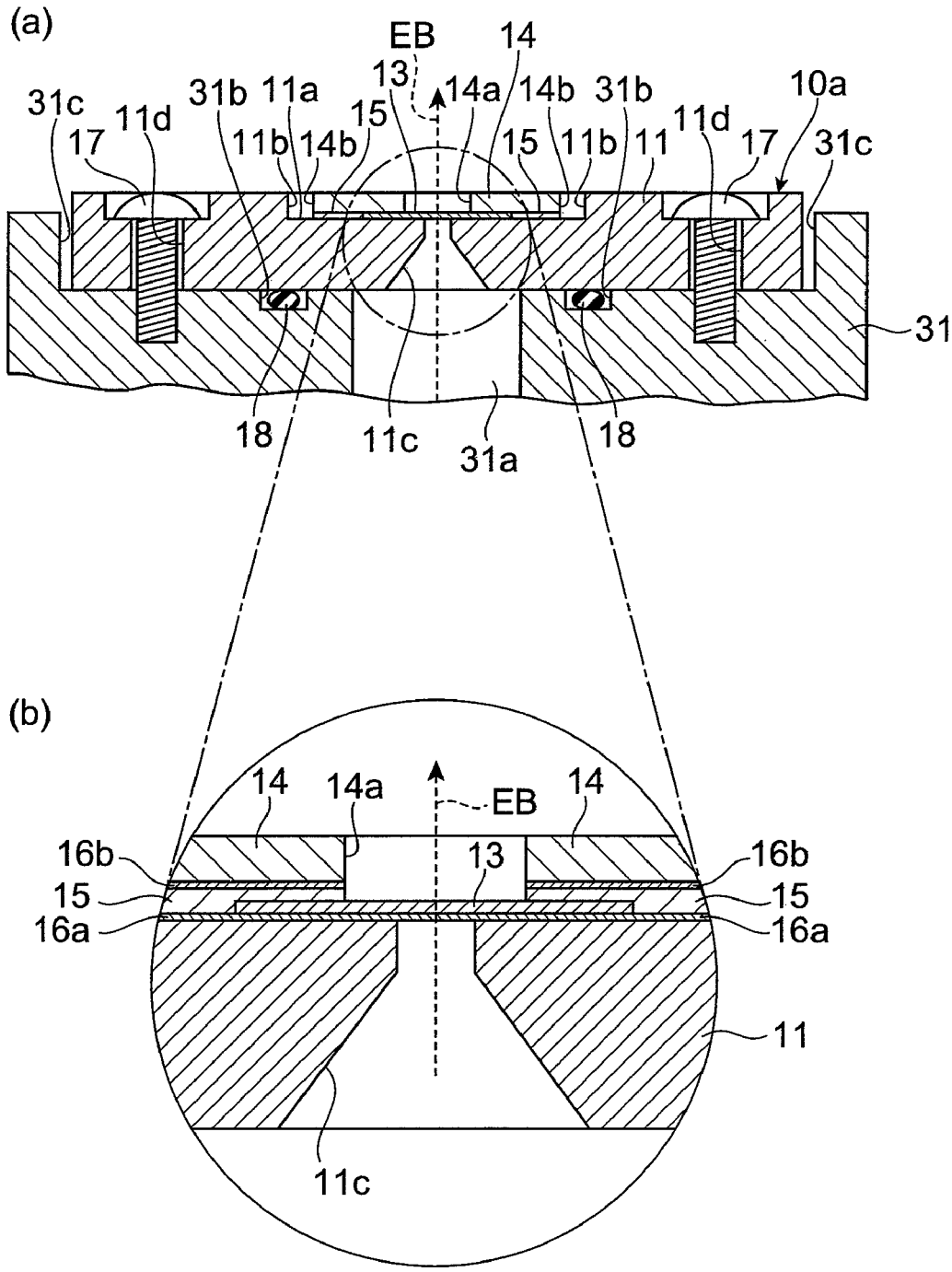
FIG. 3 is a side sectional view illustrating a window unit of the first embodiment and a structure around the window unit, and an enlarged sectional view of a main part of the window unit.
Figure 4:
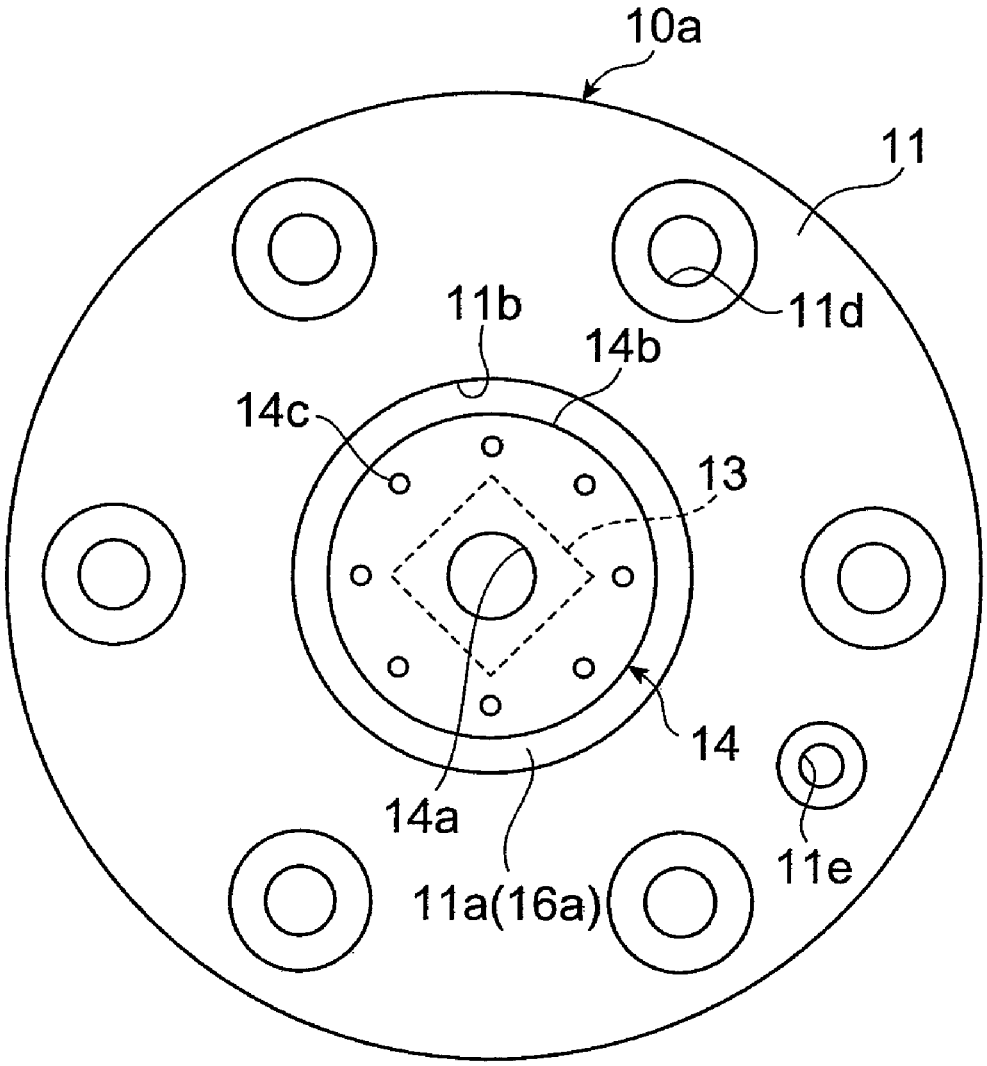
FIG. 4 is a plan view illustrating a structure of the window unit.

The window unit 10*a* is a component to emit an electron beam EB emitted from the electron gun 2 out of the vacuum container 3, and is detachably attached to the forward end of the vacuum container 3 (i.e., to the end of the electron passage 3*b*) in the beam emission direction. FIG. 3(*a*) is a side sectional view illustrating the window unit 10*a* of this embodiment and a structure around the window unit 10*a*. FIG. 3(*b*) is an enlarged sectional view of a main part of the window unit 10*a* of FIG. 3(*a*). FIG. 4 is a plan view illustrating a structure of the window unit 10*a*.

The window unit 10*a* has a substantially disk-shaped exterior, and is made up of the frame material 11, the window material 13, and the fixing member 14. The frame material 11 is a substantially disk-shaped member, and is made of metal such as stainless steel. The frame material 11 is disposed on a plane enclosed by the wall of a stepped part 31*c*. To position the frame material 11, the stepped part 31*c* is formed on the pedestal 31. It is recommended to form the planar shape of the stepped part 31*c* in accordance with the planar shape of the frame material 11.

The frame material 11 has a concave part 11*a* that holds the window material 13 and the fixing member 14, an electron passing hole 11*c* through which an electron beam EB passes, and a bolt hole lid through which the bolt 17 passes. Among these elements, the electron passing hole 11*c* is bored through the frame material 11 in the direction of emission of an electron beam EB, and is formed at the middle of the frame material 11. The width (inner diameter) of the electron passing hole 11*c* faced to the pedestal 31 (i.e., faced to the vacuum container 3) is expanded in a tapered manner toward the inside of the vacuum container 3. On the other hand, the width (inner diameter) of the electron passing hole 11*c* on the side opposite to the pedestal 31 is substantially constant in the direction of emission of an electron beam EB. In other words, the electron passing hole 11*c* consists of a part that has a substantially constant diameter from the electron emission side and a part that is reduced in diameter like a tapered manner from the electron incidence side (i.e., the side of the vacuum container 3) toward the electron emission side so as to be linked to the constant diameter part.

The concave part 11*a* is formed so that the bottom face of the concave part 11*a* includes an end of the electron passing hole 11*c*, and has a circular shape when viewed from the thickness direction of the window unit 10*a* (i.e., from the direction of emission of an electron beam EB). The bolt holes 11*d* are formed around the concave part 11*a* as shown in FIG. 4, and are plurally arranged in the circumferential direction of the frame material 11. The frame material 11 is fixed to the pedestal 31 by inserting the bolt 17 into the bolt hole 11*d* and then screwing the bolt 17 to a threaded hole of the pedestal 31. The frame material 11 is detached from the pedestal 31 by removing the bolt 17 therefrom.

The frame material 11 has a threaded hole 11*e* differing from the bolt hole lid. The threaded hole 11*e* is used when the window unit 10*a* is not easily removed from the pedestal 31 because the bolt 17 is too tightly screwed so that the window unit 10*a* is firmly fixed to the pedestal 31. In other words, the pedestal 31 does not have a threaded hole corresponding to the threaded hole lie, and, when a screw is screwed to the threaded hole 11*e*, the forward end of the screw comes into contact with the pedestal 31 and is stopped. As a result, a force to pull the frame material 11 and the pedestal 31 apart from each other is applied to the frame material 11, and hence the window unit 10*a* can be easily detached from the pedestal 31. Preferably, the threaded hole 11*e* is disposed outside the O ring 18 (described later) when viewed from the electron passing hole 11*c*. If the threaded hole 11*e* is disposed outside the O ring 18, fine metal powder can be prevented from entering the inside of the vacuum container 3 even when the fine metal powder is generated by contact of the forward end of the screw with the pedestal 31. Additionally, the principle of leverage effectively acts in proportion to the nearness of the position of the threaded hole 11*e* to the outer periphery of the frame material 11, and the frame material 11 can be detached by less power.

The window material 13 is a film member through which an electron beam EB emitted from the electron gun 2 is allowed to penetrate and is emitted from the vacuum container 3 outwardly. The window material 13 is made of a material (e.g., beryllium, titanium, or aluminum) that can be penetrated by the electron beam EB. The window material 13 is formed to have a thickness of, for example, several microns (μm) to ten microns (μm), and is much thinner than, for example, a window material used in an X-ray generator. The window material 13 is disposed on the bottom face of the concave part 11*a* of the frame material 11 in such a way as to cover one end of the electron passing hole 11*c* of the frame material 11. The window material 13 is brazed to the frame material 11 by use of a brazing material 15, and hence is airtightly bonded thereto so as to stop up the electron passing hole 11*c*. The window material 13 may be airtightly bonded to the frame material 11 not only by brazing but also by welding or the like. One surface of the window material 13 is located outside the vacuum container 3, and is in contact with the atmosphere. The other surface of the window material 13 is located inside the vacuum container 3.

The fixing member 14 is a member used to reliably fix the window material 13 to the frame material 11. The fixing member 14 is annularly formed, and has an opening 14*a* at its center part. The fixing member 14 is disposed on the bottom face of the concave part 11*a* and on the window material 13 so that the opening 14*a* communicates with the electron passing hole 11*c* of the frame material 11, and, as a result, the window material 13 is interposed between the frame material 11 and the fixing member 14. The outer diameter of the fixing member 14 is set to be smaller than the inner diameter of the concave part 11*a*. A gap lies between a side face 14*b* of the fixing member 14 and a sidewall 11*b* of the concave part 11*a*. This gap is much larger than a gap that is generally provided by being caused by the tolerance between components. For example, this gap is from several percent to several tens of percent of the inner diameter of the concave part 11*a*.

The space between the fixing member 14 and the frame material 11 is filled with the brazing material 15 as shown in FIG. 3(*b*). A part of the brazing material 15 is in contact with the window material 13. The fixing member 14 is brazed to the window material 13 and the frame material 11 in this way, and, as a result, the window material 13 is firmly bonded to the frame material 11, and airtightness between the frame material 11 and the window material 13 is heightened. The fixing member 14 may have spot welding marks 14*c* shown in FIG. 4. The spot welding mark 14*c* is a mark left by the application of spot welding onto the frame material 11 in order to temporarily join the fixing member 14 when the fixing member 14 is brazed to the frame material 11. Since spot welding is performed while avoiding the window material 13, the place surrounding the window material 13 is studded with the spot welding marks 14*c*.

Additionally, as shown in FIG. 3(*b*), a metallic film 16*a* to heighten the adhesive properties of the brazing material 15 is formed on the surface of the frame material 11 on the side where this is in contact with the brazing material 15 (i.e., on the bottom face of the concave part 11*a* of the frame material 11). Likewise, a metallic film 16*b* is formed on the surface of the fixing member 14 on the side where this is in contact with the brazing material 15. Each of the metallic films 16*a* and 16*b* is made of a metallic material (e.g., copper) having physical or chemical compatibility with the brazing material 15, and is formed by vapor deposition or the like. Since the outer diameter of the fixing member 14 is smaller than the inner diameter of the concave part 11*a* in this embodiment, the metallic film 16*a* is exposed from the gap between the side face 14*b* of the fixing member 14 and the sidewall 11*b* of the concave part 11*a*.

The electron beam generating apparatus 1*a* further includes the O ring 18. The O ring 18 is a sealing member in this embodiment. A gap between the frame material 11 and the vacuum container 3 (pedestal 31) is airtightly sealed with the O ring 18. The O ring 18 is made of an elastic material, such as resin, and is disposed in such a way as to surround the electron passing hole 11*c* between the frame material 11 and the pedestal 31. A groove 31*b* to receive and position the O ring 18 is formed on the vacuum container 3 side. The O ring 18 is held in the groove 31*b*.

Referring again to FIG. 1 and FIG. 2, other components of the electron beam generating apparatus 1*a* will be described. The electron gun 2 includes an insulating block 4, a case 5 containing the insulating block 4, a high-pressure type connector 6 attached to the side face of the case 5, a filament 7 that is an electron emission member used to emit electrons, internal electric wires 9*a* and 9*b* each of which serves as a high voltage part, and an electroconductive member 16 with which a part of the insulating block 4 is covered.

The case 5 is made of an electroconductive material, such as metal, and contains the insulating block 4 described later. The case 5 has an opening 5*a* and an opening 5*b*. The opening 5*a* leads from the inside of the case 5 to the housing chamber 3*a* of the vacuum container 3, whereas the opening 5*b* leads from the inside of the case 5 to the outside of the electron beam generating apparatus 1*a*. The opening 5*a* is a circular opening through which the internal electric wires 9*a* and 9*b* are passed. The opening 5*b* is a circular opening used to attach the connector 6.

The insulating block 4 is made of insulating resin, such as epoxy resin, and insulates the high voltage part (internal electric wires 9*a* and 9*b*) of the electron gun 2 and the other parts (e.g., the case 5) from each other. More specifically, the insulating block 4 has a base 4*a* and a convex part 4*b* protruding from the base 4*a*. The base 4*a* is contained in the case 5 so as to occupy almost all of the inside of the case 5. The convex part 4*b* projects from the base 4*a* through the opening 5*a*, and is in an exposed state from the case 5. The filament 7 is disposed on the convex part 4*b* (near the forward end of the convex part 4*b* in this embodiment). A concavo-convex shape is formed on the inner surface of the case 5 being in contact with the insulating block 4. Therefore, when the resinous insulating block 4 is molded, the resin gets into the concavo-convex shape and is hardened, and hence the insulating block 4 and the case 5 are fixed firmly. The grooved shape shown in FIG. 1 or a fine rugged part generated by roughing the inside of the case 5 can be mentioned as an example of the concavo-convex shape described here.

The high-pressure type connector 6 is a connector (receptacle) used to receive the supply of power supply voltage from the outside of the electron beam generating apparatus 1*a*, and is disposed at the opening 5*b* in such a way as to penetrate through the sidewall of the case 5. A part 6*a* of the connector 6 located in the case 5 is buried and fixed in the base 4*a* of the insulating block 4. The surface of the part 6*a* has a concavo-convex shape. Therefore, when the insulating block 4 is molded, the insulating block 4 gets into the concavo-convex shape and is hardened, and hence the insulating block 4 and the connector 6 are fixed firmly. A shape in which a convexity and a concavity are alternately formed in the direction of the center axis of the connector 6 as shown in FIG. 1 or a fine rugged part generated by ruining the surface of the connector 6 can be mentioned as an example of the concavo-convex shape described here.

The connector 6 is fixed to the sidewall of the case 5. The insulating block 4 and the case 5 are firmly fixed to each other with the connector 6 therebetween. A power source plug holding a forward end of an external electric wire extending from a power-supply unit (not shown) is inserted into the connector 6.

The filament 7 is a member used to emit electrons of an electron beam EB. Both ends of the filament 7 are connected to the internal electric wires 9*a* and 9*b*, respectively, extending from the connector 6 to the filament 7. Therefore, when the power source plug is inserted into the connector 6, both ends of the filament 7 are electrically connected to the power-supply unit through the external electric wire. The filament 7 is heated to about 2500° C. by passing an electric current of several amperes therethrough, and discharges electrons by applying a high voltage of several tens of kilovolts (kV) to several hundreds of kilovolts (kV) from another power-supply unit thereonto. The filament 7 is covered with a grid part 8 that forms an electric field to pull out electrons. A predetermined voltage is applied onto the grid part 8 through an electric wire (not shown). Therefore, electrons discharged from the filament 7 are emitted from a hole formed in a part of the grid part 8 in the form of an electron beam EB. The internal electric wires 9*a* and 9*b* undergo the application of a high voltage from the power-supply unit as mentioned above, and are securely insulated from the case 5 by being buried in the inside of the insulating block 4 made of an insulating material.

Preferably, the vacuum container 3 is structured to be divided into container parts between which, for example, a boundary plane intersecting the electron emission direction lies, and a hinge (not shown) is provided at the boundary plane so that the housing chamber 3*a* can be opened and closed. If the vacuum container 3 has this open type structure, the filament 7, which is a consumable material, can be easily exchanged with another.

The electroconductive member 16 is an electrically conductive member used to cover a surface part, which has a gap between this part and the case 5, of the surface of the insulating block 4. More specifically, preferably, the electroconductive member 16 is a thin member, such as an electrically conductive film or an electrically conductive tape, and is stuck onto the insulating block 4 so as to completely cover a surface part, which is not in direct contact with the case 5, of the insulating block 4. The electroconductive member 16 may be an electrically conductive paint or an electrically conductive film.

Preferably, the electron beam generating apparatus 1*a* further includes a vacuum pump 50 that exhausts air from the inside of the vacuum container 3. Since the window unit 10*a* of this embodiment is detachable from the vacuum container 3, there is a need to bring the vacuum container 3 into a vacuum state, for example, when the window unit 10*a* is exchanged with another. Additionally, if the vacuum container 3 is an open type container as mentioned above, there is a need to bring the vacuum container 3 into a vacuum state even after the filament 7 is exchanged with another. Air can be easily expelled from the vacuum container 3 by allowing the electron beam generating apparatus 1*a* to include the vacuum pump 50. The vacuum pump 50 is connected to the housing chamber 3*a* of the vacuum container 3 through an exhaust passage 3*d*.

The vacuum pump 50 is disposed along the side face of the case 5 excluding a side face part at which the connector 6 is disposed. This arrangement of the vacuum pump 50 makes it possible to reduce the size of the electron beam generating apparatus 1*a* while avoiding the interference of the vacuum pump 50 with the external electric wires and the power source plug inserted in the connector 6.

A description will be given of the operation of the thus structured electron beam generating apparatus 1*a* according to this embodiment. First, air is exhausted from the inside of the vacuum container 3 by use of the vacuum pump 50, and the vacuum container 3 is brought into a vacuum state. The power source plug of the power-supply unit prepared outside the electron beam generating apparatus 1*a* is inserted into the connector 6. As a result, the power-supply unit and the internal electric wires 9*a* and 9*b* are electrically connected together. Thereafter, an electric current of several amperes is applied from the power-supply unit, and a power supply voltage of from several tens of kilovolts (kV) to several hundreds of kilovolts (kV) is applied from another power-supply unit. This power supply voltage is supplied to the filament 7 through the internal electric wires 9*a* and 9*b*, and electrons are discharged from the filament 7.

Electrons discharged from the filament 7 are accelerated by the grid part 8, and are transformed into an electron beam EB. The electron beam EB passes through the electron passage 3*b*, and reaches the window unit 10*a*. At this time, the electron beam EB is converged by the electromagnetic coil 3*c*. According to circumstances, the electron beam EB performs axial correction by use of the electromagnetic coil 3*d*. The electron beam EB penetrates through the window material 13 of the window unit 10*a*, and is emitted from the electron beam generating apparatus 1*a* outwardly.

A description will be given of effects brought about by the electron beam generating apparatus 1*a* according to this embodiment. In the electron beam generating apparatus 1*a*, the window material 13 is joined to the frame material 11 so as to airtightly stop up the electron passing hole 11*c* of the frame material 11. Therefore, an elastic sealing member, such as an O ring, becomes unnecessary between the frame material 11 and the window material 13, and a joint part (e.g., brazing material 15) can sufficiently resist heat brought from the window material 13. Therefore, the sealing state between the frame material 11 and the window material 13 will hardly deteriorate, and the vacuum state of the inside of the vacuum container 3 can be maintained for a longer time. Additionally, since the frame material 11 is detachably attached to the vacuum container 3, the window unit 10*a* can be installed without giving a stress to the window material 13 when the electron beam generating apparatus 1*a* is manufactured or when the window unit 10*a* is exchanged with another. Therefore, with the electron beam generating apparatus 1*a* according to this embodiment, a non-uniform stress onto the window material 13 can be almost completely removed, and hence damage to the window material 13 can be effectively reduced.

Still additionally, preferably, the electron beam generating apparatus 1*a* has the O ring 18 with which a gap between the frame material 11 and the vacuum container 3 is sealed as in this embodiment, and the groove 31*b* to hold the O ring 18 is formed on the vacuum container 3 side (i.e., on the pedestal 31 side in this embodiment). As a result, a transfer of heat from the window material 13 to the O ring 18 becomes more difficult than in an example in which the groove to hold the ring 18 is formed on the window unit 10*a* side, and hence the longevity of the O ring 18 can be extended.

Still additionally, preferably, the width (inner diameter) of the electron passing hole 11*c* of the frame material 11 faced to the vacuum container 3 is increased toward the inside of the vacuum container 3 in a tapered manner as in this embodiment. In the electron beam generating apparatus 1*a* according to this embodiment, the frame material 11 is bonded (e.g., brazed) to the window material 13, and hence heat can be easily transferred from the window material 13 to the frame material 11. If this fact is employed, an increase in temperature of the window material 13 can be effectively curbed by heat radiation from the frame material 11. The width (inner diameter) of the electron passing hole 11*c* faced to the vacuum container 3 is expanded in a tapered manner, and the amount of heat radiated from the electron passing hole 11*c* is increased, thereby making it possible to effectively curb an increase in temperature of the window material 13.

If the tapered shape of the electron passing hole 11*c* reaches its end faced to the window material 13, the opening edge of the electron passing hole 11*c* being in contact with the window material 13 has an acute angle, and hence there is a fear that this will damage the window material 13. Therefore, preferably, the width (inner diameter) of the electron passing hole 11*c* faced to the window material 13 is formed to be substantially constant in the electron emission direction.

Still additionally, preferably, the vacuum container 3 (pedestal 31) has the stepped part 31*c* that positions the frame material 11 as in this embodiment. With this structure, the detachable frame material 11 can be easily attached to the vacuum container 3 (pedestal 31), and the window material 13 can be reliably prevented from being positionally deviated from the axis line of emission of an electron beam EB.

Still additionally, preferably, the electron gun 2 has the electroconductive member 16 with which a part, which has a gap between this part and the case 5, of the surface of the insulating block 4 is covered as in this embodiment. With this structure, the electric potential of the surface of the insulating block 4 at which a gap lies between the surface and the case 5 can be made to have the same electric potential (e.g., earth potential) as the case 5. Therefore, a shield effect with respect to, for example, the internal electric wires 9*a* and 9*b* can be advantageously fulfilled.

Still additionally, preferably, a part 6*a* of the connector 6 is buried in the insulating block 4, and the connector 6 has a concavo-convex shape on the surface of this part 6*a* as in this embodiment. With this structure, the insulating block 4 gets into the concavo-convex shape of the connector 6 and is hardened when the insulating block 4 is molded, and hence the insulating block 4 and the connector 6 can be firmly fixed together.

Still additionally, preferably, a part 6*a* of the connector 6 is buried in the insulating block 4, and the connector 6 is fixed to the case 5 as in this embodiment. With this structure, the insulating block 4 and the case 5 can be firmly fixed together with the connector 6 placed therebetween.

A description will be given of one example concerning a method for manufacturing the window unit 10*a* according to this embodiment. In the following method, a beryllium film having an effective output diameter of 2 mm and having a thickness of 10 μm was used as the window material 13. A material containing Ag as a principal constituent and having a plate thickness of 0.1 mm was used as the brazing material 15. Stainless steel was used as the vacuum container 3 (including the pedestal 31), as the frame material 11, and as the fixing member 14.

First, the frame material 11 and the fixing member 14 are cut out from a stainless steel ingot. A beryllium film and a brazing material each of which has a predetermined outer diameter are cut out to prepare the window material 13 and the brazing material 15. At this time, the outer diameter of the window material 13 is made larger than the opening diameter of the electron passing hole 11*c* faced to the window material 13. The outer diameter of the brazing material 15 is made larger than the outer diameter of the window material 13. It is recommended to make the outer diameter of the fixing member 14 substantially equal to the outer diameter of the brazing material 15. Specifically, the following sizes are employed. The opening diameter of the electron passing hole 11*c* is 2 mm. The window material 13 is 6 mm square. The outer diameter of the fixing member 14 and that of the brazing material 15 are each 13 mm, and the inner diameter of the fixing member 14 and that of the brazing material 15 are each 4 mm.

No limitations are imposed on the external shape of the window material 13 if the window material 13 covers the electron passing hole 11*c* and does not bulge out from the brazing material 15. Although the external shape of the window material 13 is rectangular in consideration of processing easiness in this embodiment, this may be, for example, circular in the same way as the other members.

Thereafter, the cut surface of each member is burred. The window material 13 comes into contact particularly near the opening of the electron passing hole 11*c* in the frame material 11. Therefore, it is desirable to completely remove a burr by various machine grinding operations or electrolytic polishing processing. Thereafter, each metal member (vacuum container 3, frame material 11, and fixing member 14) is subjected to heat treatment (about 900° C.) in a vacuum, so that gas discharging and distortion reduction are performed.

Thereafter, copper is vacuum-deposited so as to have a thickness of about 200 nm on the surface of the fixing member 14, the surface of the window material 13, and the surface of the frame material 11 with which the brazing material 15 is in contact. As a result, the brazing material 15 is excellently suited to each member.

Figure 5:
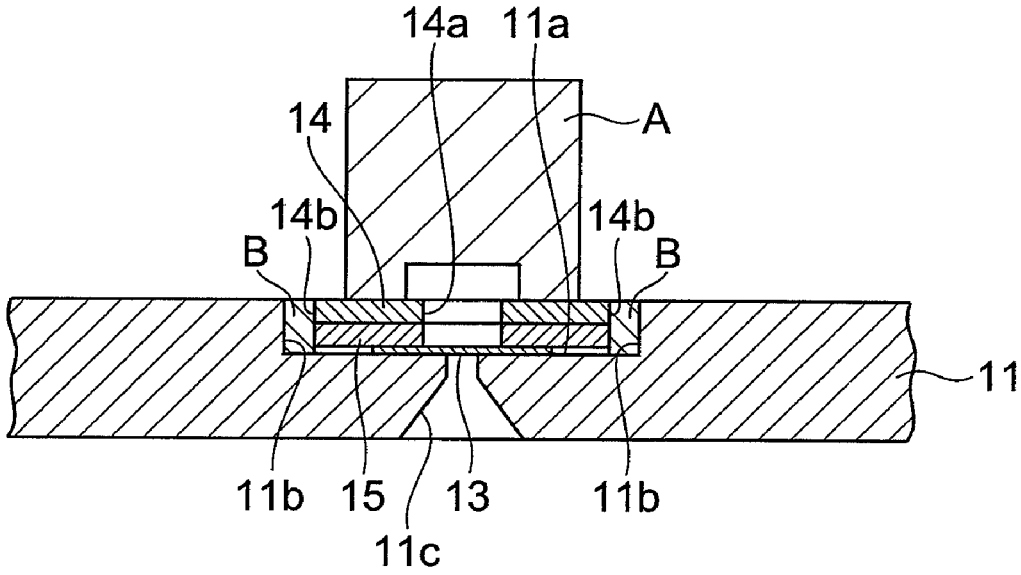
FIG. 5 is a sectional view illustrating a process of bonding and uniting a frame material, a window material, and a fixing member together by melting a soldering material therein.

Thereafter, the frame material 11, the window material 13, and the fixing member 14 are bonded and united together by melting the brazing material 15. FIG. 5 is a sectional view showing this process. As shown in FIG. 5, first, the window material 13, the brazing material 15, and the fixing member 14 are piled up in this order in the concave part 11*a* of the frame material 11. Thereafter, a jig "A" is placed thereon. The jig "A" is used to prevent each member from being positionally deviated when the brazing material 15 is melted. The jig "A" is made of, for example, stainless steel (SUS304), and has an outer diameter of 12 mm, an inner diameter of 6 mm, and a height of 20 mm as an example.

Preferably, when the brazing material 15 is melted, a jig "B" is used to more reliably prevent the fixing member 14 from being positionally deviated. The jig "B" is an annular jig fitted in a gap between the sidewall 11*b* of the concave part 11*a* and the side face 14*b* of the fixing member 14. Since the fixing member 14 can be positioned by placing the jig "B" there, the center of the opening 14*a* of the fixing member 14 can be easily allowed to coincide with the center of the electron passing hole 11*c* of the frame material 11. To prevent the fixing member 14 from being positionally deviated, it is permissible to lightly spot-weld the fixing member 14 and the frame material 11 together around the window material 13 and to temporarily join the fixing member 14 to the frame material 11. Each of the spot welding marks 14*c* shown in FIG. 4 is a welding mark formed at this time. Therefore, the center of the opening 14*a* of the fixing member 14 and the center of the electron passing hole 11*c* of the frame material 11 can coincide with each other with high accuracy.

Thereafter, each member is put into an electric furnace of a vacuum heating furnace without changing the state shown in FIG. 5, and is subjected to heat treatment. The brazing material 15 composed as mentioned above is heated from room temperature to about 700° C., is then kept at this temperature for five minutes, is then stopped being heated, and is cooled to about 650° C. Thereafter, each member is taken out from the electric furnace, and is cooled to about 300° C. Thereafter, each member is rapidly cooled by a vacuum leak using dry nitrogen so as to reach the room temperature or so. Thereafter, the window unit 10*a* in which the members are united together is taken out from the vacuum heating furnace. Finally, the sealing state between the frame material 11 and the window material 13 is examined by, for example, a helium leak detector, thus confirming that no leak has occurred.

Modifications

Figure 6:
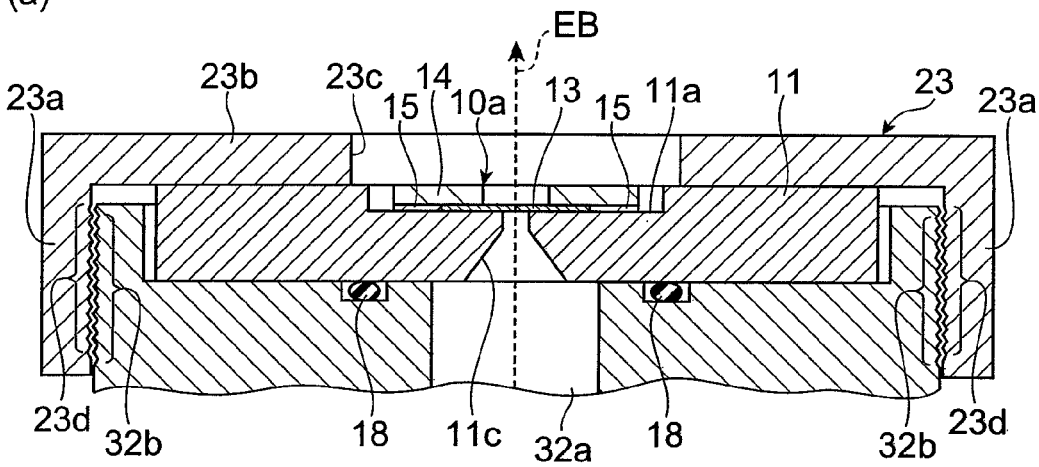
FIG. 6 is a sectional view illustrating first and second modifications of the first embodiment.
Figure 6:
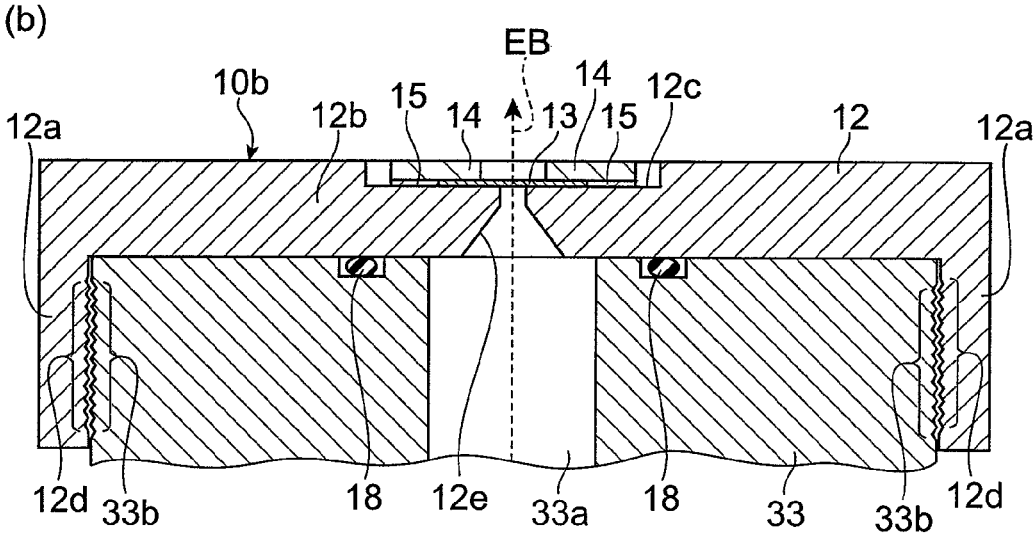

Next, a description will be given of modifications of the window unit according to this embodiment and of how to install the window unit. FIG. 6(*a*), (*b*), and FIG. 7(*a*), (*b*) are sectional views showing first, second, third, and fourth modifications, respectively.

A structure according to the first modification of FIG. 6(*a*) and the above-mentioned embodiment differ from each other in how to install the window unit. In detail, the electron beam generating apparatus of this modification includes a presser member 23 instead of the bolt 17 of the first embodiment. The presser member 23 is screwed to the vacuum container (pedestal 32) while pressing the outer circumferential part of the frame material 11, thereby fixing the window unit 10*a* to the vacuum container (pedestal 32). In more detail, the presser member 23 is formed by integrally uniting a cylindrical screw part 23*a* and a planar part 23*b* disposed at an end of the screw part 23*a* together. The inner diameter of the screw part 23*a* is substantially equal to the outer diameter of the pedestal 32. A screw thread 23*d* is formed on the inner circumferential surface of the screw part 23*a*. This screw thread 23*d* is screwed to a screw thread 32*b* formed on the outer circumferential surface of the pedestal 32, and, as a result, the presser member 23 is screwed to the pedestal 32. At this time, the planar part 23*b* presses the frame material 11 of the window unit 10*a* toward the pedestal 32.

The presser member 23 has a circular opening 23*c* formed in the planar part 23*b* to allow an electron beam EB to pass therethrough. The inner diameter of the opening 23*c* is made larger than the inner diameter of the concave part 11*a* of the frame material 11, so that the planar part 23*b* does not come into contact with the fixing member 14.

The electron beam generating apparatus may fix the window unit 10*a* (frame material 11) by means of the presser member 23 as in this modification. This structure also makes it possible to detachably attach the window unit 10*a* (frame material 11) to the vacuum container. Additionally, in this modification, the window unit 10*a* can be attached to the vacuum container in a shorter time than in an example in which the window unit 10*a* is fixedly screwed. In this modification, the frame material 11 may have a bolt hole 11*d* (see FIG. 3(*a*) and FIG. 4). If so, the frame material 11 is fixed to the vacuum container by either of or both of the presser member 23 shown in FIG. 6(*a*) and the bolts 17 shown in FIG. 3(*a*).

A structure according to the second modification of FIG. 6(*b*) and the above-mentioned embodiment differ from each other in how to install the window unit. In detail, the window unit 10*b* of this modification includes a frame material 12 instead of the frame material 11 of the first embodiment. The frame material 12 is fixed to the vacuum container by being screwed to the pedestal 33. In more detail, the frame material 12 is formed by integrally uniting a cylindrical screw part 12*a* and a planar part 12*b* disposed at an end of the screw part 12*a* together. The inner diameter of the screw part 12*a* is substantially equal to the outer diameter of the pedestal 33. A screw thread 12*d* is formed on the inner circumferential surface of the screw part 12*a*. This screw thread 12*d* is screwed to a screw thread 33*b* formed on the outer circumferential surface of the pedestal 33, and, as a result, the window unit 10*b* is screwed to the vacuum container (pedestal 33).

As the frame material 11 of the first embodiment does, the frame material 12 includes a concave part 12*c* to hold the window material 13 and the fixing member 14 and an electron passing hole 12*e* that communicates with a through-hole 33*a* of the pedestal 33 and through which an electron beam EB passes. The window material 13 is disposed in such a way as to stop up the electron passing hole 12*e*, and the frame material 12, the window material 13, and the fixing member 14 are joined together by means of the brazing material 15. The pedestal 33 differs from the pedestal 31 of the first embodiment in the fact that the pedestal 33 has no stepped part used to position the window unit 10*b*.

The frame material 12 may be structured to be screwed to the vacuum container (pedestal 33) in the same way as the window unit 10*b* of this modification. This structure also makes it possible to advantageously realize the window unit 10*b* (frame material 12) attachable to and detachable from the vacuum container.

Figure 7:
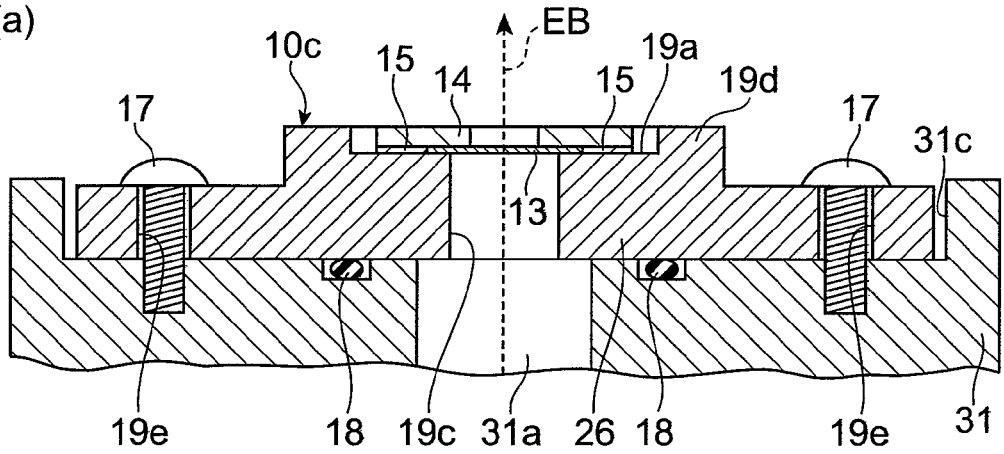
FIG. 7 is a sectional view illustrating third and fourth modifications of the first embodiment.
Figure 7:
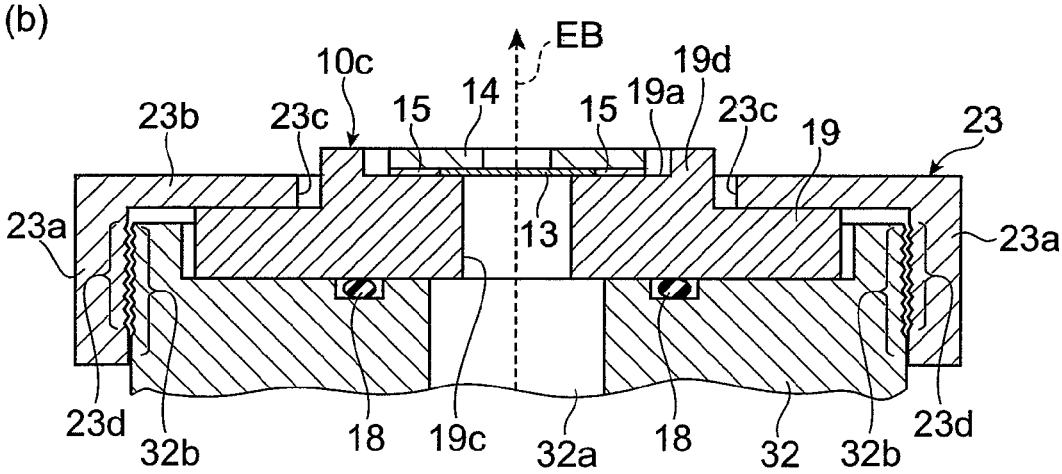

A structure shown in FIG. 7(*a*) according to the third modification differs from the above-mentioned embodiment in the shape of the frame material. That is, the window unit 10*c* of this modification has a frame material 19 instead of the frame material 11 of the above-mentioned embodiment. The frame material 19 is a substantially disk-shaped member, and includes a concave part 19*a* to hold the window material 13 and the fixing member 14, an electron passing hole 19*c* that communicates with a through-hole 31*a* of the pedestal 31 and through which an electron beam EB passes, and a bolt hole 19*e* through which the bolt 17 passes. A part near the concave part 19*a* of the frame material 19 is thicker than the outer circumferential part including the bolt hole 19*e*, and hence is formed as a convex part 19*d*. Although the inner diameter of the electron passing hole 19*c* is constant in the electron emission direction in this modification, the inner diameter of the electron passing hole 19*c* faced to the vacuum container may be increased in a tapered manner in the same way as the electron passing hole 11*c* of the first embodiment.

If a part near the concave part 19*a* of the frame material 19 is formed thicker than the outer circumferential part like the window unit 10*c* of this modification, the deformation of the part near the concave part 19*a* can be lessened when the window unit 10*c* is attached to the pedestal 31 by use of the bolt 17, and the window material 13 can be prevented from undergoing a non-uniform stress.

Additionally, since the window material 13 is bonded to the frame material 19 as described above, heat can be easily transferred from the window material 13 to the frame material 19. Still additionally, heat is generated even in the frame material 19 when an electron beam deviating from a predetermined emission axis line enters the frame material 19. Even in this case, a thermal capacity near the concave part 19*a* is increased by making the part near the concave part 19*a* of the frame material 19 thicker than the outer circumferential part, and hence the thermal expansion of the frame material 19 can be reduced, and the application of stress onto the window material 13 can be prevented.

Still additionally, a fastening force generated by the bolt 17 is effectively transmitted to the frame material 19 and to the pedestal 31 by making the outer circumferential part including the bolt hole 19*e* comparatively thin as in this modification, and hence a gap between the frame material 19 and the pedestal 31 can be sealed more reliably.

The fourth modification shown in FIG. 7(*b*) has a structure in which the window unit 10*c* according to the third modification shown in FIG. 7(*a*) is fixed by the presser member 23 according to the first modification shown in FIG. 6(*a*). In other words, the electron beam generating apparatus according to this modification includes the window unit 10*c* and the presser member 23. The window unit 10*c* is structured in the same way as in the third modification mentioned above. The presser member 23 is screwed to the vacuum container (pedestal 32) while pressing the outer circumferential part of the frame material 19, thereby fixing the window unit 10*c* to the vacuum container (pedestal 32).

The presser member 23 is formed by integrally uniting a cylindrical screw part 23*a* and a planar part 23*b* disposed at an end of the screw part 23*a* together. The inner diameter of the screw part 23*a* is substantially equal to the outer diameter of the pedestal 32. The screw thread 23*d* formed on the inner circumferential surface of the screw part 23*a* is screwed to the screw thread 32*b* formed on the outer circumferential surface of the pedestal 32, and, as a result, the presser member 23 is screwed to the pedestal 32. At this time, the planar part 23*b* of the presser member 23 presses the frame material 19 of the window unit 10*c* toward the pedestal 32. The presser member 23 has a circular opening 23*c* through which an electron beam EB passes. The inner diameter of the opening 23*c* is made larger than the outer diameter of the convex part 19*d* of the frame material 19, and the convex part 19*d* protrudes from the opening 23*c*.

According to this modification, since the frame material 19 of the window unit 10*c* has the convex part 19*d*, the same effect as in the third modification can be obtained. Additionally, since the window unit 10*c* (frame material 19) is fixed by the presser member 23, the window unit 10*c* can be attached to the vacuum container in a shorter time than in an example in which the window unit 10*c* is fixed by screwing.

Second Embodiment

Figure 8:
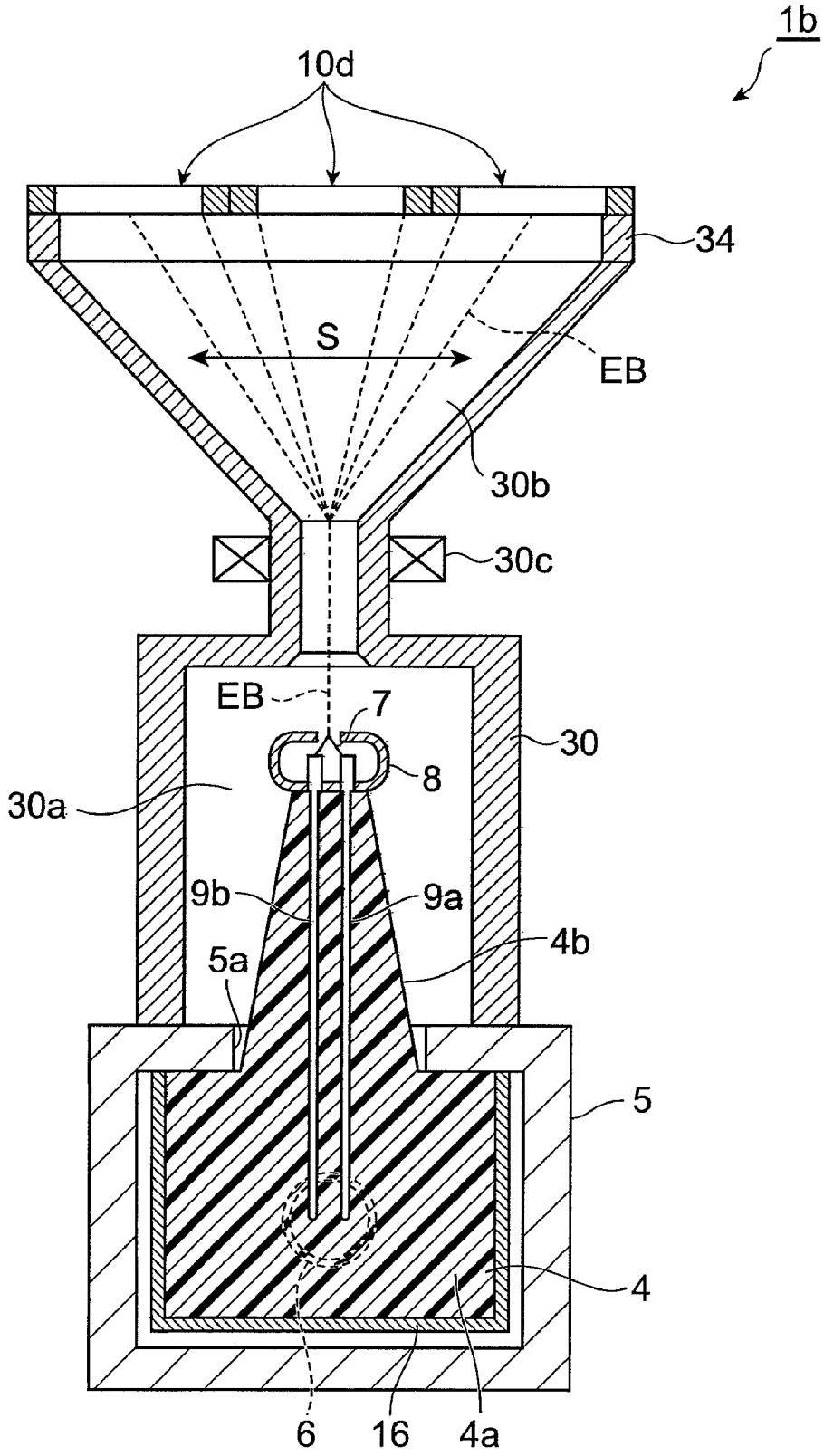
FIG. 8 is a sectional view illustrating a structure of a second embodiment of the electron beam generating apparatus of the present invention.
Figure 9:
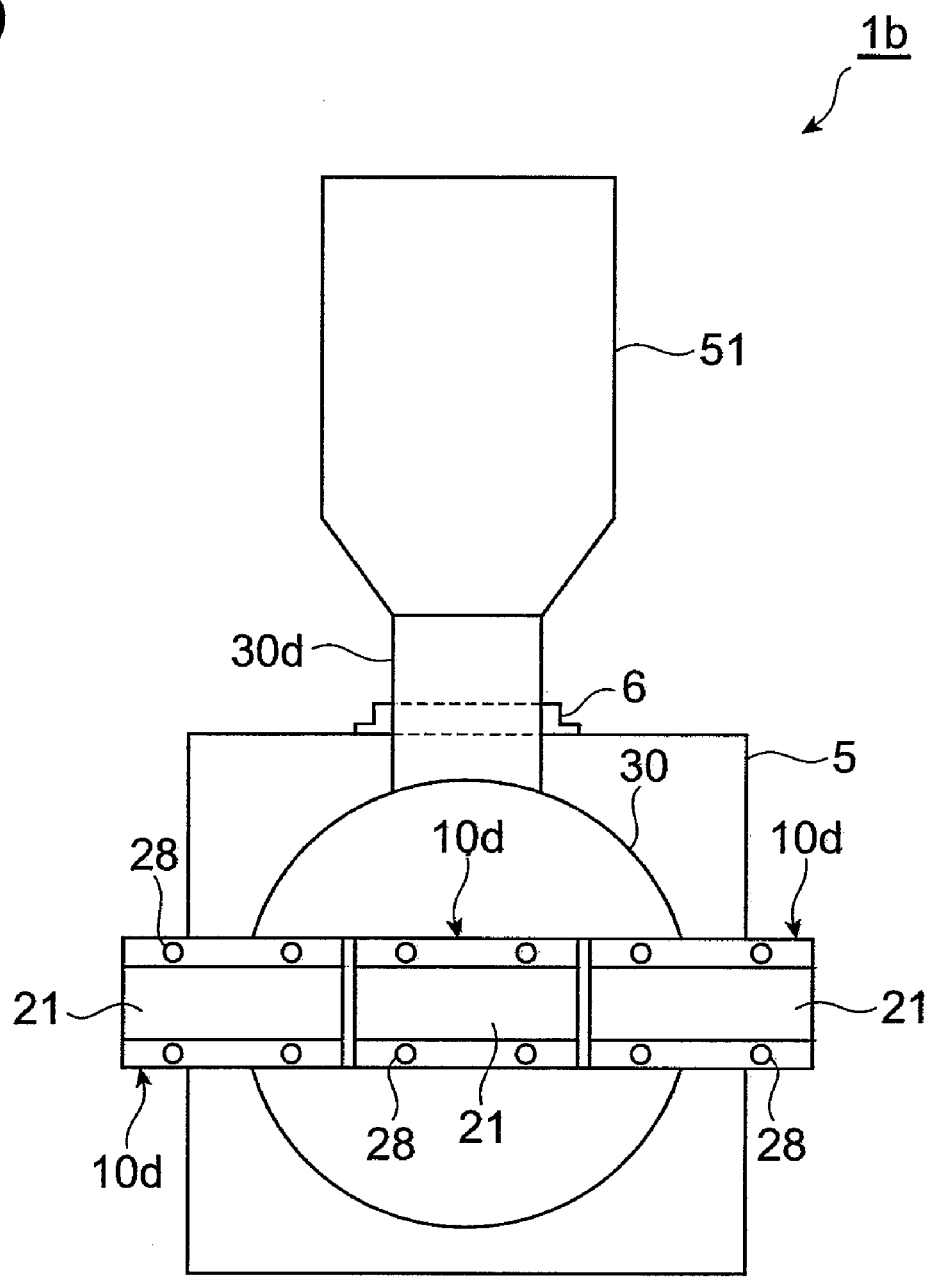
FIG. 9 is a plan view of the electron beam generating apparatus of FIG. 8.

FIG. 8 is a sectional view illustrating a structure of a second embodiment of the electron beam generating apparatus according to the present invention. FIG. 9 is a plan view of the electron beam generating apparatus of FIG. 8. The electron beam generating apparatus 1*b* of this embodiment includes the electron gun 2 that emits an electron beam EB, the vacuum container 30, and a plurality of window units 10*d*. Since the electron gun 2 among these elements is structured in the same way as in the first embodiment, a detailed description thereof is omitted.

The vacuum container 30 holds the filament 7 of the electron gun 2 and airtightly seals this. The vacuum container 30 includes a housing chamber 30*a* and an electron passage 30*b*. The housing chamber 30*a* houses the filament 7 of the electron gun 2, the grid part 8, and the convex part 4*b*. The electron passage 30*b* is extended in the direction of emission of an electron beam EB emitted from the electron gun 2, and communicates with the housing chamber 30*a*. A cylindrical electromagnetic coil 30*c* that functions as an electromagnetic deflection lens is disposed around the electron passage 30*b*.

The electron passage 30*b* is expanded in a sector shape toward its forward end from a boundary at which the electromagnetic coil 30*c* is disposed. In other words, in the electron passage 30*b*, only the width in a certain direction intersecting with the direction of electron emission of the electron gun 2 (hereinafter, this direction is referred to as a "scan direction", which is indicated by arrow S in the figure) is gradually expanded, whereas the width in another direction intersecting therewith is constant. Therefore, with the scan direction S regarded as the longitudinal direction, the forward end of the electron passage 30*b* is slenderly extended. A pedestal 34 used to fix the window unit 10*d* is disposed at the forward end of the electron passage 30*b*.

An electron beam EB emitted from the electron gun 2 also passes through the electron passage 30. At this time, the direction of emission of the electron beam EB is deflected by the electromagnetic coil 30*c*. Accordingly, the emission axis line of the electron beam EB is moved along the scan direction S. The electron beam EB reaches the window unit 10*d* disposed at the forward end of the vacuum container 30.

Figure 10:
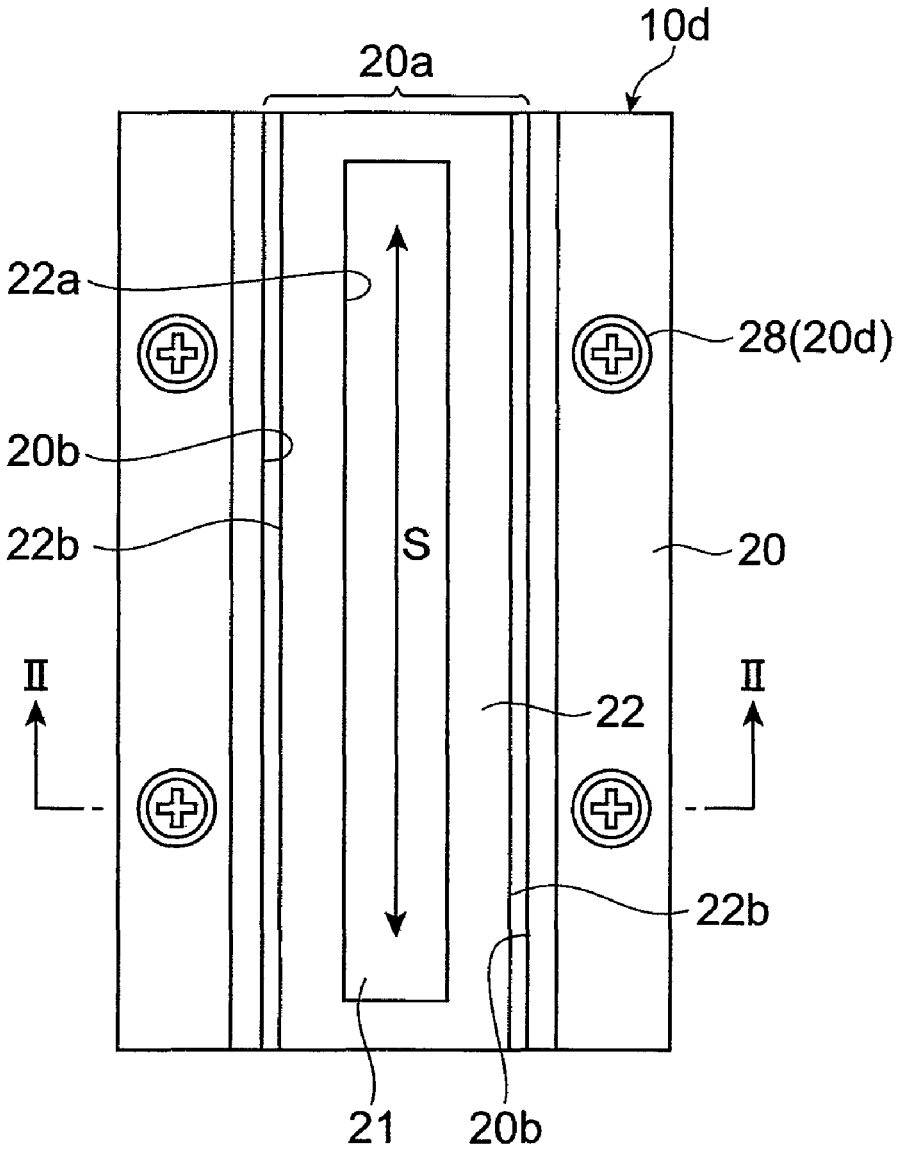
FIG. 10 is a plan view illustrating a structure of a window unit of the second embodiment.
Figure 11:
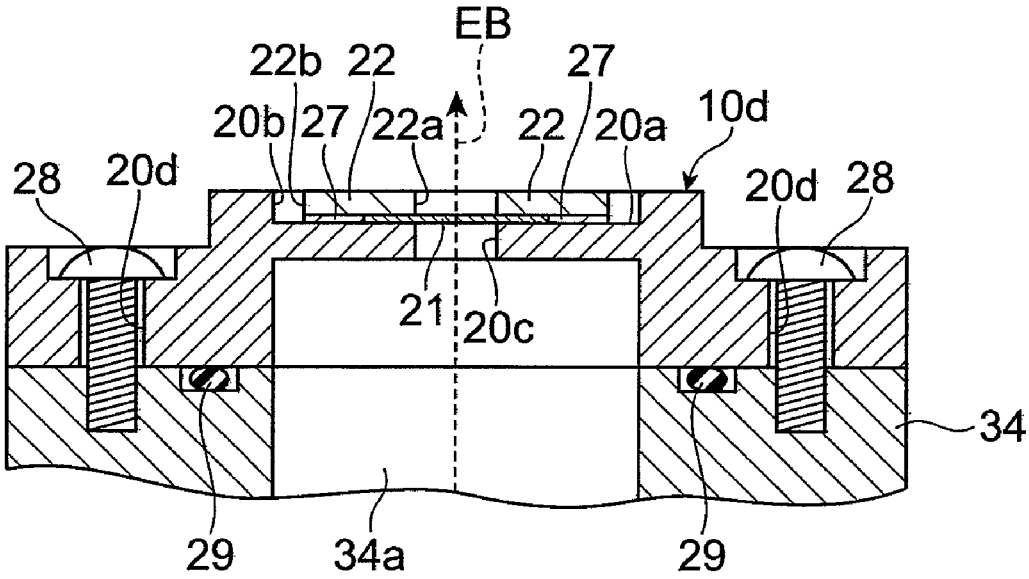
FIG. 11 is a side sectional view along line II-II of the window unit of FIG. 10.
Figure 12:
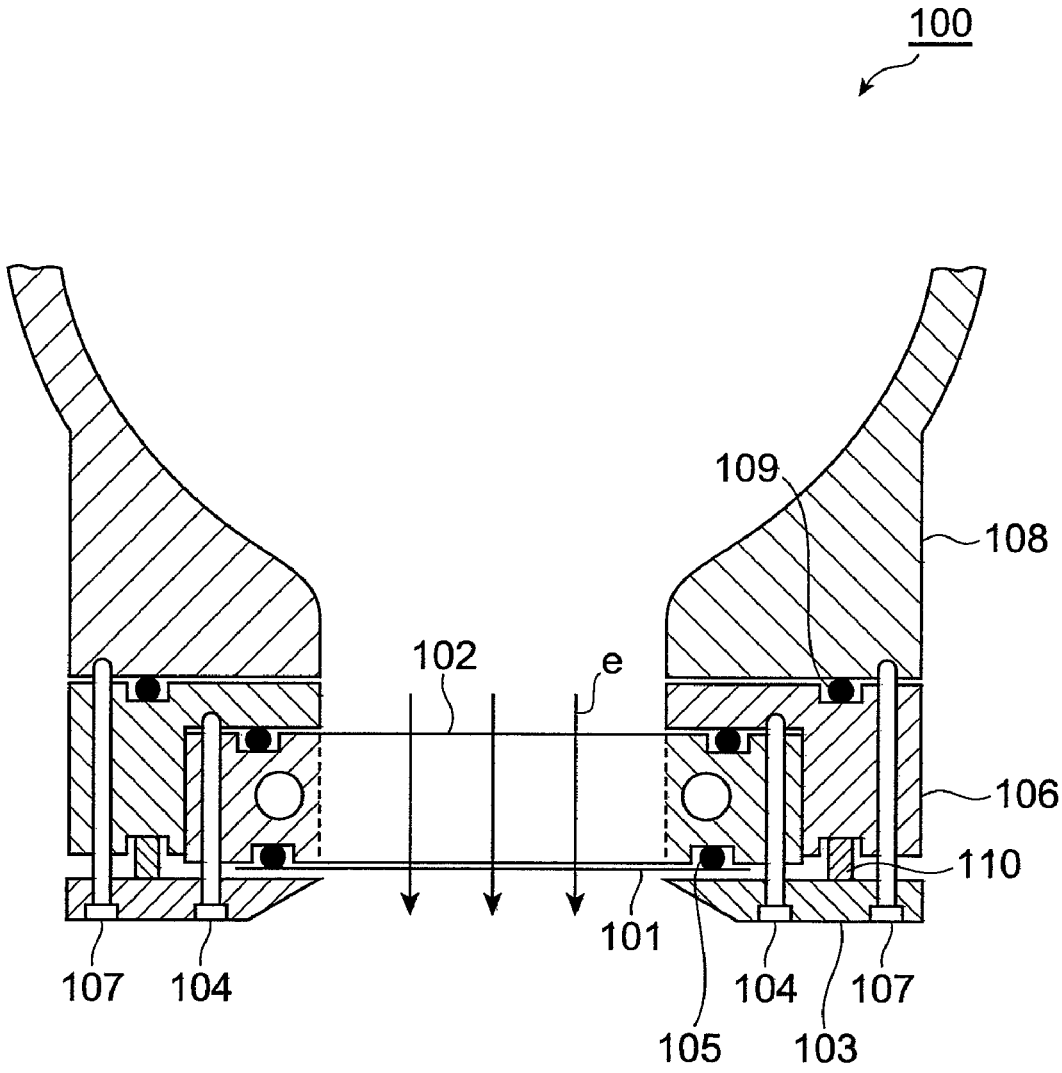
FIG. 12 is a view illustrating a structure of an irradiation window of a conventional electron beam generating apparatus.

The plurality of window units 10*d* are components used to emit an electron beam EB emitted from the electron gun 2 outwardly from the vacuum container 30, and are arranged side by side along the scan direction S at the forward end (end of the electron passage 30*b*) of the vacuum container 30. FIG. 10 is a plan view illustrating a structure of the window unit 10*d* of this embodiment. FIG. 11 is a side sectional view along line II-II of the window unit 10*d* of FIG. 10.

Referring to FIG. 10 and FIG. 11, the window unit 10*d* has its plane formed in a rectangular shape, and includes the frame material 20, the window material 21, and the fixing member 22. The frame material 20 is made of metal, such as stainless steel, and is fixed to the vacuum container 30 by means of bolts 28. The frame material 20 has a concave part 20*a* to hold the window material 21 and the fixing member 22, an electron passing hole 20*c* through which an electron beam EB passes, and a bolt hole 20*d* through which the bolt 28 passes. The electron passing hole 20*c* which is one of these elements penetrates through the frame material 20 in the direction of emission of an electron beam EB, and has its plane formed in a rectangular shape in which the scan direction S is a longitudinal direction.

The concave part 20*a* is formed so that its bottom face contains an end (opening) of the electron passing hole 20*c*, and reaches both ends of the frame material 20 in the scan direction S. The bolt holes 20*d* are formed so as to be arranged side by side in the scan direction S on both sides of the concave part 20*a*. The bolt 28 is inserted into the bolt hole 20*d*, and is screwed and engaged with the threaded hole of the pedestal 34, and thereby the frame material 20 is fixed to the pedestal 34. When the bolts 28 are removed therefrom, the frame material 20 is detached from the pedestal 34.

The window material 21 is a film member used to allow an electron beam EB emitted from the electron gun 2 to penetrate therethrough and be emitted outwardly from the vacuum container 30. The window material 21 is disposed on the bottom face of the concave part 20*a* in such a way as to cover the end of the electron passing hole 20*c* of the frame material 20. The window material 21 is brazed to the frame material 20 by use of a brazing material 27, and is airtightly bonded to the frame material 20 so as to stop up the electron passing hole 20*c*.

The fixing member 22 is used to reliably fix the window material 21 to the frame material 20. The fixing member 22 is formed in a rectangular shape having an opening 22*a* at its center part. The fixing member 22 is disposed on the bottom face of the concave part 20*a* and on the window material 21 so that the opening 22*a* communicates with the electron passing hole 20*c* of the frame material 20, and hence the window material 21 is interposed between the frame material 20 and the fixing member 22. The outer diameter (i.e., width in a direction perpendicular to the scan direction S) of the fixing member 22 is made smaller than the width of the concave part 20*a*. There is a gap between the side face 22*b* of the fixing member 22 and the sidewall 20*b* of the concave part 20*a*. This is a gap into which a jig having the same action as the jig B shown in FIG. 5 is fitted.

The gap between the fixing member 22 and the frame material 20 is filled with the brazing material 27. A part of this brazing material 27 comes into contact with the window material 21. The window material 21 is firmly bonded to the frame material 20, and airtightness between the frame material 20 and the window material 21 is heightened by brazing the fixing member 22 to the frame material 20 and the window material 21 in this way.

A sealing member (O ring 29) is placed between the frame material 20 and the vacuum container 30 (pedestal 34) in the same way as in the first embodiment. The O ring 29 airtightly seals the gap between the frame material 20 and the vacuum container 30 (pedestal 34). Additionally, this embodiment is the same as the first embodiment in the fact that a groove to hold the O ring 29 is formed on the vacuum container 30 side (i.e., on the pedestal 34 side).

The electron beam generating apparatus 1*b* further includes a vacuum pump 51 used to expel air from the inside of the vacuum container 30 (see FIG. 2) as the electron beam generating apparatus 1*a* does. The vacuum pump 51 protrudes from the side face of the vacuum container 30 on the side where the connector 6 is disposed. The connector 6 and the vacuum pump 51 are disposed in the same direction with respect to the center axis line of the electron beam generating apparatus 1*b* by disposing the vacuum pump 51 in this way, and hence it becomes easy to insert or pull out a power source plug into or from the connector 6 and to maintain the vacuum pump 51. The vacuum pump 51 is connected to the housing chamber 30*a* of the vacuum container 30 through an exhaust passage 30*d*.

The electron beam generating apparatus according to the present invention may include a rectangular window unit 10*d* or may include a plurality of window units 10*d* as the electron beam generating apparatus 1*b* of this embodiment does. Especially in an electron beam generating apparatus of a type in which scanning is linearly performed with an electron beam EB, a structure in which the window unit 10*d* can be attached and detached can be easily realized without damaging the window material 21 by arranging the plurality of window units 10*d* along the scan direction S as in this embodiment. Although the window units 10*d* are arranged side by side in this embodiment, a single window unit extending in the scan direction S may be disposed instead of the plurality of window units 10*d*.

Without being limited to the above-mentioned embodiments and modifications, the electron beam generating apparatus according to the present invention can be variously modified. For example, although the frame material whose electron passing hole is circular is shown in the first embodiment and although the frame material whose electron passing hole is rectangular is shown in the second embodiment, the electron passing hole of the frame material can have various shapes without being limited to the above-mentioned shapes. Furthermore, it is recommended to appropriately change the planar shape of the fixing member, that of the window material, and that of the concave part of the frame material in accordance with the shape and size of the electron passing hole.

Additionally, in the above-mentioned embodiments, an epoxy-resin-made block is used as one example of the insulating block. However, the insulating block in the present invention is not limited to the epoxy-resin-made block. The insulating block may be made of other insulating materials such as ceramic or silicone resin. Additionally, although a structure supplying a high voltage from the connector is employed in the above-mentioned embodiments, a boosting circuit may be provided in the insulating block.

The invention claimed is:

1. An electron beam generating apparatus comprising:

an electron gun that has an electron emitting member from which an electron beam is emitted;

a container that holds the electron emitting member;

a frame material detachably attached to the container, the frame material having an electron passing hole through which the electron beam passes;

a window material that is bonded to the frame material so as to airtightly stop the electron passing hole and through which the electron beam penetrates;

a sealing member with which a gap between the frame material and the container is airtightly sealed; and a groove formed on a side of the container, the groove holding the sealing member, wherein the frame material has a threaded hole disposed away from the scaling member when viewed from the electron passing hole, wherein the container does not have a threaded hole corresponding to the threaded hole of the frame material so that when a screw is screwed into the threaded hole, the screw provides a force to pull the frame material and the container apart from each other that is applied to the frame material, wherein the container has a stepped part by which the frame material is positioned, and wherein a wall of the stepped part and a sidewall of the frame material are spaced apart from each other.

2. The electron beam generating apparatus according to claim 1, wherein the window material is brazed to the frame material.

3. The electron beam generating apparatus according to claim 1, further comprising a fixing member having an opening through which the electron beam passes, the window material being interposed between the fixing member and the frame material, the fixing member being brazed to the window material and to the frame material.

4. The electron beam generating apparatus according to claim 3, wherein the frame material has a concave part whose bottom face contains an end of the electron passing hole, the fixing member is disposed on the bottom face, and a gap lies between a sidewall of the concave part and a side face of the fixing member.

5. The electron beam generating apparatus according to claim 3, wherein the fixing member is spot-welded to the frame material.

6. The electron beam generating apparatus according to claim 1, wherein the frame material is screwed and fastened to the container.

7. The electron beam generating apparatus according to claim 1, further comprising a presser member that is screwed to the container while pressing the frame material.

8. The electron beam generating apparatus according to claim 1, wherein a width of the electron passing hole faced to the container is expanded in a tapered manner toward an inside of the container.

9. The electron beam generating apparatus according to claim 1, wherein the container further includes a plane enclosed by the wall of the stepped part, and wherein the frame material is disposed in the plane enclosed by the wall of the stepped part and spaced apart from the wall of the stepped part.

10. The electron beam generating apparatus according to claim 1, wherein the frame material is disposed over the groove on the side of the container, and wherein the sealing member is disposed in the groove formed on the side of the container such that the sealing member is between the container and the frame material.

* * * * *